US009421674B2

(12) United States Patent
Chu

(10) Patent No.: US 9,421,674 B2
(45) Date of Patent: Aug. 23, 2016

(54) QUICK DRIVING MECHANISM FOR RATCHET TOOL

(71) Applicant: Te Chen Chu, Taichung (TW)

(72) Inventor: Te Chen Chu, Taichung (TW)

( * ) Notice: Subject to any disclaimer, the term of this patent is extended or adjusted under 35 U.S.C. 154(b) by 317 days.

(21) Appl. No.: 14/244,055

(22) Filed: Apr. 3, 2014

(65) Prior Publication Data

US 2015/0283682 A1 Oct. 8, 2015

(51) Int. Cl.

| | |
|---|---|
| ***B25B 23/00*** | (2006.01) |
| ***B25B 15/04*** | (2006.01) |
| ***B25B 17/00*** | (2006.01) |
| ***B25G 1/06*** | (2006.01) |
| ***B25G 1/08*** | (2006.01) |

(52) U.S. Cl.

CPC ..... *B25B 23/0028* (2013.01); *B25B 15/04* (2013.01); *B25B 17/00* (2013.01); *B25G 1/066* (2013.01); *B25G 1/085* (2013.01)

(58) Field of Classification Search

CPC ... B25B 23/0028; B25B 15/04; B25B 17/00; B25G 1/066; B25G 1/085; B25G 3/38

USPC ..... 81/177.8, 177.9

See application file for complete search history.

(56) References Cited

U.S. PATENT DOCUMENTS

| | | | | |
|---|---|---|---|---|
| 5,802,936 | A * | 9/1998 | Liu | B25B 13/56 81/177.4 |
| 6,216,565 | B1 * | 4/2001 | McCann | B25G 1/063 403/97 |
| 6,311,584 | B1 | 11/2001 | Chu | |
| 6,450,067 | B1 | 9/2002 | Liao | |
| 6,745,480 | B1 * | 6/2004 | Liao | B23D 49/14 30/519 |
| 6,935,211 | B2 | 8/2005 | Chen | |
| 7,055,411 | B2 | 6/2006 | Huang | |
| 7,181,996 | B1 | 2/2007 | Chu | |
| 7,197,965 | B1 * | 4/2007 | Anderson | B25B 13/481 81/177.9 |
| 7,267,033 | B1 | 9/2007 | Lai | |
| 7,311,186 | B2 | 12/2007 | Liao | |
| 7,571,517 | B2 * | 8/2009 | Smith | B25G 1/005 16/422 |
| 7,698,972 | B2 * | 4/2010 | Hi | B25B 13/465 81/177.7 |
| 8,402,865 | B2 * | 3/2013 | Lin | B25G 1/066 81/177.8 |
| 8,869,658 | B2 * | 10/2014 | Chou | B25G 1/007 403/322.4 |
| 9,126,314 | B1 * | 9/2015 | Chu | B25B 17/00 |
| 9,156,145 | B2 * | 10/2015 | Wang | B25B 13/462 |
| 9,174,333 | B2 * | 11/2015 | Rubin | B25F 1/04 81/490 |
| 2007/0034058 | A1 * | 2/2007 | Chen | B25B 13/461 81/58 |
| 2009/0223329 | A1 * | 9/2009 | Hi | B25G 1/085 81/177.8 |
| 2014/0224081 | A1 * | 8/2014 | Lee | B25B 13/08 81/177.8 |

* cited by examiner

*Primary Examiner* — David B Thomas
(74) *Attorney, Agent, or Firm* — Charles E. Baxley

(57) ABSTRACT

A ratchet driving tool includes a handle having a lateral aperture, a housing pivotally attached to the handle and having a hole aligned with the aperture of the handle, and two depressions formed in the housing and communicating with the hole of the housing, a ratchet driving mechanism is attached to the housing, a latch is slidably engaged in the through hole of the housing and the aperture of the handle, the latch includes a key slidably engageable with either of the depressions of the housing for anchoring the housing to the handle at a selected angular position and for allowing the ratchet driving tool to be easily actuated or operated by the user.

15 Claims, 5 Drawing Sheets

QUICK DRIVING MECHANISM FOR RATCHET TOOL

BACKGROUND OF THE INVENTION

1. Field of the Invention

The present invention relates to a ratchet driving tool, and more particularly to a ratchet driving tool including an improved driving mechanism for selectively and quickly actuating or operating the ratchet driving tool to quickly engage with and to quickly rotate or drive the extension tools or fasteners or the like.

2. Description of the Prior Art

Typical ratchet driving tools comprise a ratchet mechanism for selectively engaging with the extension tools or fasteners or the like and for selectively rotating or driving the extension tools or fasteners or the like.

For example, U.S. Pat. No. 6,450,067 to Liao, U.S. Pat. No. 6,935,211 to Chen, U.S. Pat. No. 7,055,411 to Huang, and U.S. Pat. No. 7,311,186 to Liao disclose several of the typical ratchet driving tools each comprising a ratchet mechanism for engaging with the driving shank or stem and for selectively actuating or operating the ratchet driving tools to engage with and to rotate or drive the extension tools or fasteners or the like.

However, the typical ratchet driving tools may only be provided to engage with and to drive the extension tools or fasteners or the like, but may not be actuated or operated to quickly engage with and to rotate or drive the extension tools or fasteners.

U.S. Pat. No. 6,311,584 to Chu, U.S. Pat. No. 7,181,996 to Chu, and U.S. Pat. No. 7,267,033 to Lai disclose several other typical ratchet driving tools each also comprising a ratchet mechanism for selectively engaging with the driving shank or stem and for selectively actuating or operating the ratchet driving tools to engage with and to rotate or drive the extension tools or fasteners or the like, and an additional driving mechanism for selectively engaging with and for selectively actuating or operating the ratchet driving tools to engage with and to rotate or drive the extension tools or fasteners or the like.

However, the additional driving mechanisms for the typical ratchet driving tools may only be provided to engage with and to rotate or drive the extension tools or fasteners or the like, but may not be actuated or operated to quickly engage with and to rotate or drive the extension tools or fasteners or the like.

The present invention has arisen to mitigate and/or obviate the afore-described disadvantages of the conventional ratchet driving mechanisms for tools.

SUMMARY OF THE INVENTION

The primary objective of the present invention is to provide a ratchet driving tool including an improved driving mechanism for selectively and quickly actuating or operating the ratchet driving tool to quickly engage with and to quickly rotate or drive the extension tools or fasteners or the like.

The other objective of the present invention is to provide a ratchet driving tool including a handle adjustable and pivotal relative to the driving tool body for allowing the ratchet driving tool to be easily actuated or operated by the user.

In accordance with one aspect of the invention, there is provided a ratchet driving tool comprising a handle including an aperture laterally formed therein, a holder body including a housing pivotally attached to the handle and having a bore formed in the housing, the housing including a through hole laterally formed through the housing and aligned with the aperture of the handle, and including two depressions formed in the housing and communicating with the through hole of the housing, a ratchet driving mechanism attached to the housing, a latch slidably received and engaged in the through hole of the housing and the aperture of the handle, the latch including a key slidably engageable with either of the depressions of the housing for anchoring the housing to the handle at a selected angular position.

The handle includes two ears provided thereon for forming a channel between the ears, and the aperture is laterally formed through the ears and communicating with the channel that is formed between the ears for slidably receiving and engaging with the latch.

The handle includes a block engaged in the aperture of one of the ears and having a bore formed in the block for slidably engaging with the latch, and having a slit formed in the block and communicating with the bore of the block for slidably engaging with the key of the latch.

The handle includes a spring biasing member engaged between the latch and the handle for biasing and forcing the key of the latch to engage with either of the depressions of the housing and the slit of the block.

The holder body includes a receptacle pivotally attached to the handle and engaged between the ears of the handle, and having a space formed in the receptacle for receiving and engaging with the housing. The housing includes a protrusion extended outwardly therefrom and engaged with the receptacle for securing the housing and the receptacle together.

The housing includes a cavity formed therein, and a spring biased projection is engaged in the cavity of the housing for engaging with either of the ears of the handle and for anchoring the housing and the receptacle to the handle at the selected angular position.

The ratchet driving mechanism includes a driving shank having a first end portion engaged into the bore of the housing and rotatably secured to the housing for allowing the driving shank to be rotated relative to the housing, the driving shank includes a second end portion, and includes an intermediate portion having a non-circular cross section and having an engaging surface, a casing includes a compartment formed therein for rotatably receiving and engaging with the driving shank and for allowing the casing to be rotated relative to the driving shank, the casing is engaged onto and located around the intermediate portion of the driving shank, and the casing includes at least one groove formed in the casing and communicating with the compartment of the casing for receiving and engaging with a first engaging element which is engageable with the engaging surface of the driving shank, and includes at least one slot formed in the casing and communicating with the compartment of the casing for receiving and engaging with a second engaging element which is engageable with the engaging surface of the driving shank, a first gear and a second gear each include a bore formed therein for rotatably engaging onto the casing and for being engaged onto and located around the intermediate portion of the driving shank, for allowing the first and the second engaging elements to be selectively engaged between the first and the second gears and the engaging surface of the driving shank and for determining a driving direction of the driving shank by the casing and the first and the second gears, a barrel is attached to the housing and includes a chamber formed therein for receiving the first and the second gears and the casing and the driving shank, a gearing mechanism is engaged between the first and the second gears, and a control ferrule is rotatably engaged onto the barrel and engaged with the second gear for selectively rotating the first and the second gears and for selectively rotating the driving shank with the first and the second engaging elements, and the first and the second gears are drivable by the gearing mechanism and the barrel and the housing in order to drive the driving shank with the first and the second engaging elements.

The gearing mechanism includes at least two bevel gears engaged into the chamber of the barrel and rotatably attached to the barrel with shafts and engaged with the first and the second gears. The at least two bevel gears and the shafts are equally spaced from each other.

The second gear includes a serrated portion provided thereon, and the control ferrule includes a serrated member formed thereon and engaged with the serrated portion of the second gear for allowing the second gear to be rotated by the control ferrule.

The housing includes a non-circular anchor provided thereon, and the chamber of the barrel includes a non-circular cross section for engaging with the non-circular anchor of the housing and for preventing the barrel from being rotated relative to the housing.

The casing includes at least one engaging notch formed therein, and an actuating member is rotatably engaged onto the driving shank and includes at least one engaging key for engaging with the at least one engaging notch of the casing and for allowing the casing and the first and the second engaging elements to be rotated relative to the driving shank with the actuating member.

The actuating member includes at least one engaging recess formed therein, and a sleeve is rotatably engaged onto the driving shank and includes at least one engaging projection extended therefrom for engaging with the at least one engaging recess of the actuating member and for allowing the actuating member and the casing and the first and the second engaging elements to be rotated relative to the driving shank by the sleeve.

The actuating member includes two engaging depressions formed therein, and the driving shank includes a spring biased projection extendible out of the driving shank and engageable with either of the depressions of the actuating member for positioning the actuating member and thus the casing and the first and the second engaging elements to the driving shank at selected positions.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
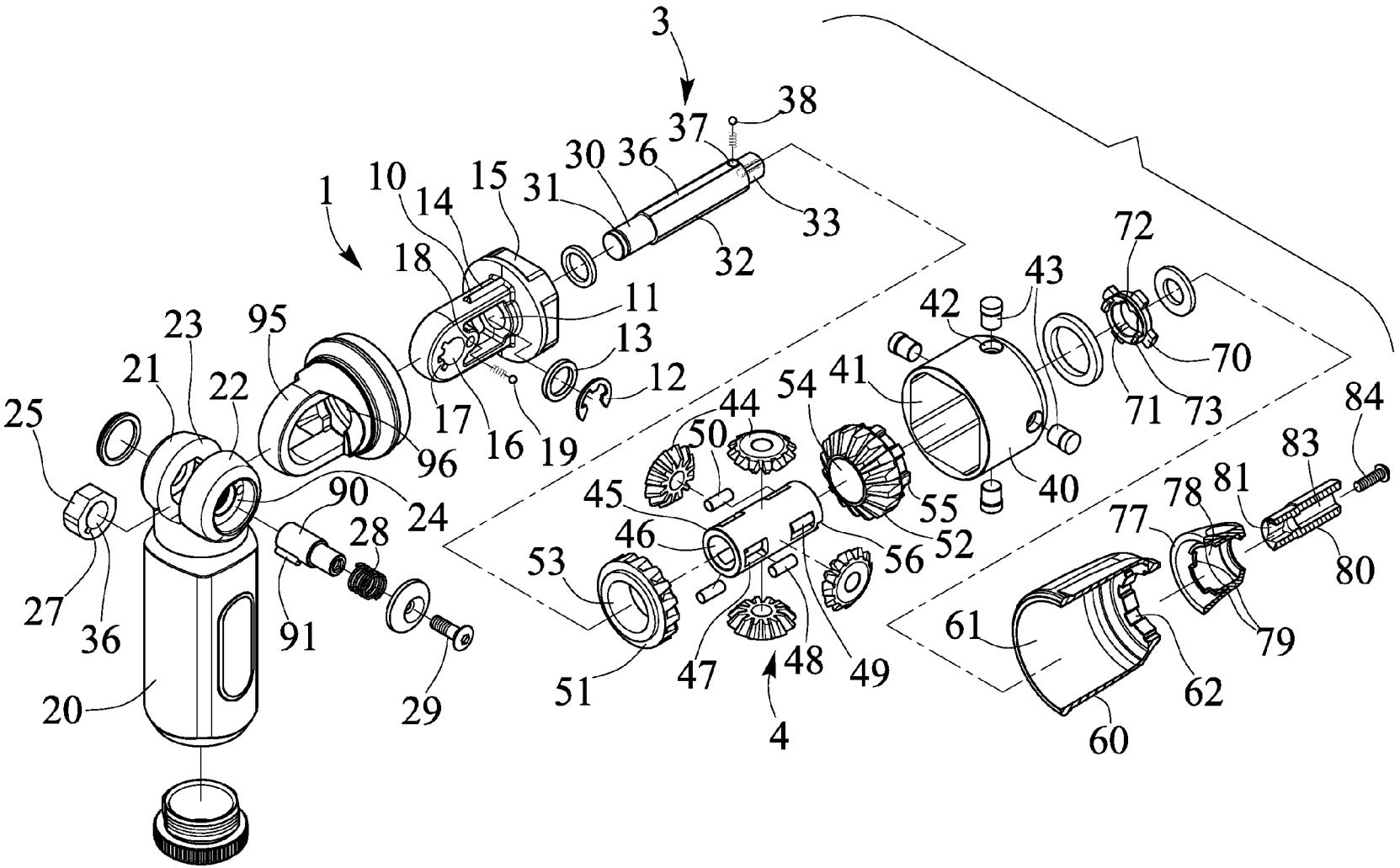
FIG. 1 is an exploded view of a ratchet driving tool in accordance with the present invention.
Figure 3:
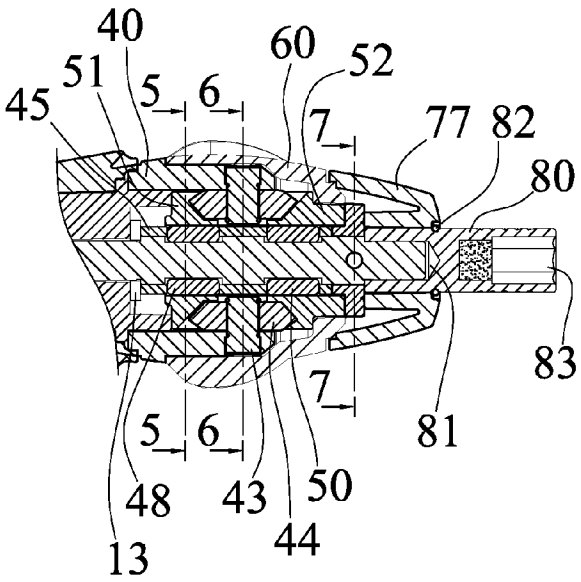
FIGS. 3, 4 are cross sectional views of the ratchet driving tool, taken along lines 3-3, 4-4 of FIG. 2 respectively.
Figure 2:
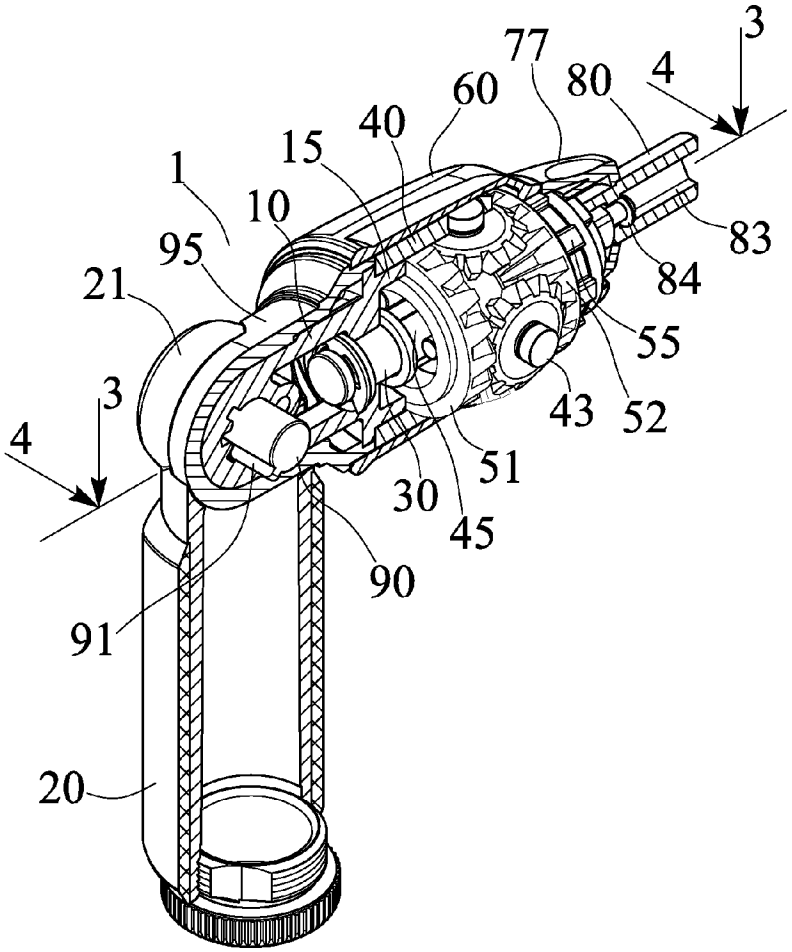
FIG. 2 is a perspective view of the ratchet driving tool, in which a portion of the ratchet driving tool has been cut off for showing the inner structure of the ratchet driving tool.
Figure 4:
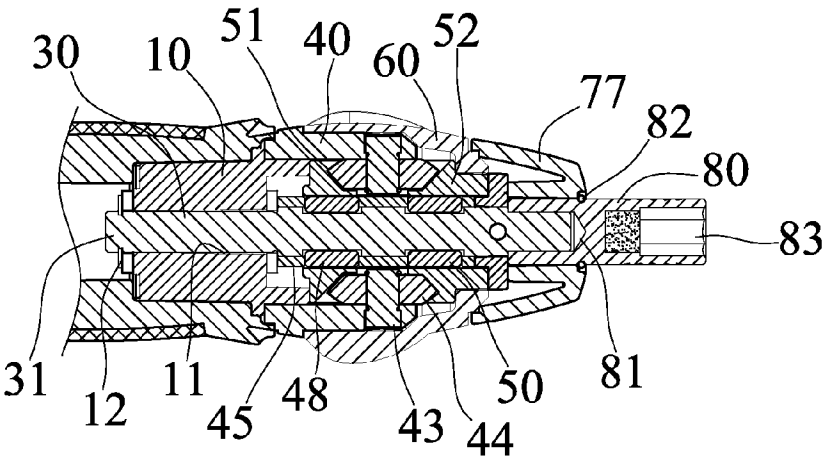
Figure 7:
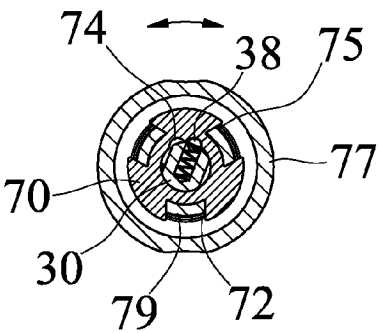
FIGS. 5, 6, 7 are cross sectional views of the ratchet driving tool, taken along lines 5-5, 6-6, and 7-7 of FIG. 3 respectively.
Figure 6:
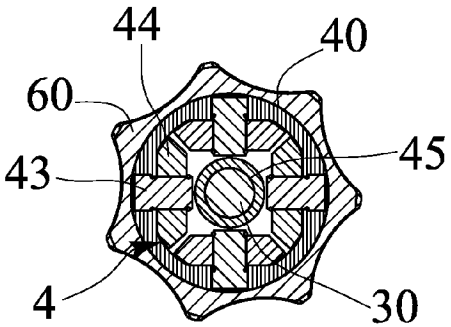

Referring to the drawings, and initially to FIGS. 1-7, a ratchet driving tool in accordance with the present invention comprises a housing or tool body or holder body 1 including a frame or housing 10 having a chamber or compartment or bore 11 longitudinally formed therein for pivotally or rotatably receiving or engaging with a follower or driving shank 30 of a ratchet driving mechanism 3, for example, the driving shank 30 includes an inner end portion or one or first end portion 31 pivotally or rotatably engaged into or with the bore 11 of the housing 10 and pivotally or rotatably attached or mounted or secured to the housing 10 with a clamping or retaining ring 12 and/or one or more washers 13 for allowing the driving shank 30 to be pivoted or rotated relative to the housing 10, but the driving shank 30 may not be slid or moved relative to the housing 10.

The housing 10 further includes a non-circular block or protrusion or anchor 15 having a non-circular cross section, such as a rectangular or square cross section, formed or provided thereon or extended therefrom (FIG. 1). The ratchet driving mechanism 3 includes a receptacle or barrel 40 having a space or compartment or chamber 41 formed therein and having a non-circular cross section, for receiving or engaging with the housing 10, particularly the non-circular anchor 15 of the housing 10 and for solidly and stably anchoring or retaining or positioning the barrel 40 to the housing 10 and for preventing the barrel 40 from being pivoted or rotated relative to the housing 10. The barrel 40 may further be solidly and stably secured to the housing 10 with latches or fasteners or locks (not illustrated), adhesives, welders or the like.

The barrel 40 includes one or more (such as four) apertures or orifices 42 formed in the outer peripheral portion thereof and intersected or communicating with the chamber 41 of the barrel 40, and one or more (such as four) rods or shafts 43 engaged into the orifices 42 of the barrel 40 respectively and mounted or secured to the barrel 40 with latches or fasteners or locks (not illustrated), force-fitted engagement, adhesives, welders or the like, and extended into the chamber 41 of the barrel 40, and a gearing mechanism 4 having one or more (such as four) pinions or bevel gears 44 attached or mounted or secured to the shafts 43 respectively and extended into or located within the chamber 41 of the barrel 40 and rotated in concert with the shafts 43 relative to the barrel 40. It is preferable that the shafts 43 and the bevel gears 44 are equally spaced from each other and freely rotatable relative to the barrel 40.

The driving shank 30 includes an outer or other or second end portion 33 extended out of the barrel 40, and a middle or intermediate portion 32 substantially extended into or through the chamber 41 of the barrel 40 and/or located within the barrel 40, the middle portion 32 of the driving shank 30 includes a non-circular cross section, such as a triangular or rectangular or square cross section (FIG. 5) having one or more (such as four) cut off portions or flat or engaging surfaces 36 formed or provided therein. The driving shank 30 includes a cavity 37 formed in the other or outer or second end portion 33 or the intermediate or middle portion 32 thereof for receiving or engaging with a spring biased projection 38 which is partially received or engaged in the cavity 37 of the driving shank 30 and which is extendible out of the driving shank 30.

A sleeve or barrel or tubular member or casing 45 is rotatably disposed or engaged onto the driving shank 30, such as the middle portion 32 of the driving shank 30 and disposed or engaged onto or located around the engaging surfaces 36 of the driving shank 30, and includes a chamber or bore or compartment 46 formed therein for rotatably receiving or engaging with the driving shank 30 and for allowing the casing 45 to be pivoted or rotated relative to the driving shank 30, and includes one or more (such as four) slots or grooves 47 formed in the rear portion thereof and communicating with the compartment 46 of the casing 45 and aligned with the engaging surfaces 36 of the driving shank 30 respectively and each for pivotally or rotatably receiving or engaging with a roller or ball or first engaging element 48 which is contactable or engageable with the engaging surfaces 36 of the driving shank 30 respectively.

The casing 45 further includes one or more (such as four) grooves or slots 49 formed in the front portion thereof (FIG. 1) and communicating with the compartment 46 of the casing 45 and aligned with the engaging surfaces 36 of the driving shank 30 respectively and each for pivotally or rotatably receiving or engaging with another roller or ball or engaging element 50 which is contactable or engageable with the engaging surfaces 36 of the driving shank 30 respectively, and the casing 45 may be pivoted or rotated relative to the driving shank 30 for moving or actuating the engaging elements 48, 50 toward or to engage with either side of the engaging surfaces 36 of the driving shank 30 (FIG. 5) and for determining the rotating or driving direction of the driving shank 30 by the casing 45 and/or the barrel 40.

A follower or pinion or bevel gear 51 and a driving or active pinion or bevel gear 52 each include a chamber or compartment or bore 53, 54 formed therein for pivotally or rotatably receiving or engaging with the casing 45, and to be disposed or engaged onto or located around the engaging elements 48, 50 respectively for allowing the engaging elements 48, 50 to be selectively engaged between the bevel gears 51, 52 and either side of the engaging surfaces 36 of the driving shank 30 (FIG. 5), and thus for allowing the rotating or driving direction of the casing 45 and the bevel gears 51, 52 and/or the barrel 40 by the driving shank 30, or the rotating or driving direction of the driving shank 30 by the bevel gears 51, 52 to be determined by the engagement of the engaging elements 48, 50 with either side of the engaging surfaces 36 of the driving shank 30.

Figure 5:
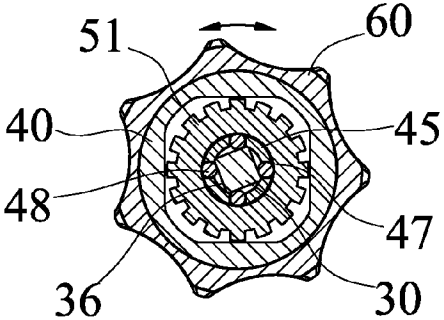

In operation, as shown in FIGS. 2-5, when the engaging elements 48, 50 are located at one side of the engaging surfaces 36 of the driving shank 30, as shown in FIG. 5, the driving shank 30 may be selectively rotated or driven clockwise by the bevel gears 51, 52, and may be selectively rotated or driven counterclockwise by the bevel gears 51, 52 when the engaging elements 48, 50 are located at the other side of the engaging surfaces 36 of the driving shank 30. The bevel gears 51, 52 are meshed or engaged with the bevel gears 44 of the gearing mechanism 4 for allowing the follower bevel gear 51 to be pivoted or rotated relative to the casing 45 with or by the driving or active bevel gear 52 and the bevel gears 44 of the gearing mechanism 4. The driving or active bevel gear 52 includes a number of teeth or a serrated portion or segment 55 formed or provided thereon.

Another tubular member or barrel or sleeve or control ferrule 60 is pivotally or rotatably engaged onto the barrel 40 and the active bevel gear 52, and includes a compartment or chamber or space 61 formed therein for pivotally or rotatably receiving or engaging with the barrel 40 and for solidly and stably anchoring or retaining or positioning the shafts 43 in the orifices 42 of the barrel 40 respectively, and the control ferrule 60 includes a number of teeth or another serrated portion or member 62 formed or provided thereon and meshed or engaged with the serrated portion or segment 55 of the active bevel gear 52 for allowing the active bevel gear 52 to be selectively rotated or driven by the control ferrule 60, and thus for allowing the driving shank 30 to be selectively rotated or driven by the control ferrule 60 with the bevel gears 51, 52 and the bevel gears 44 of the gearing mechanism 4 and the engaging elements 48, 50.

It is to be noted that the bevel gears 44 of the gearing mechanism 4 are not meshed or engaged with each other (FIG. 6), but meshed or engaged with or between the bevel gears 51, 52 (FIGS. 2-4) for allowing the follower bevel gear 51 to be pivoted or rotated relative to the casing 45 with or by the driving or active bevel gear 52 and the bevel gears 44 of the gearing mechanism 4, and thus for allowing the driving shank 30 to be selectively and quickly rotated or driven by the control ferrule 60 with the bevel gears 51, 52 and the bevel gears 44 of the gearing mechanism 4 and the engaging elements 48, 50. At this moment, the barrel 40 is solidly and stably anchored or retained or positioned to the housing 10, and the driving shank 30 is pivotable or rotatable relative to the barrel 40 and the housing 10.

The casing 45 further includes one or more engaging members or notches 56 formed therein (FIG. 1), and an operating or actuating ring or member 70 includes a chamber or compartment or bore 71 formed therein for pivotally or rotatably receiving or engaging with the driving shank 30 and for allowing the actuating member 70 to be pivoted or rotated relative to the driving shank 30, and includes one or more engaging notches or recesses 72 formed in the outer peripheral portion thereof, and includes one or more engaging ears or flaps or projections or keys 73 extended axially therefrom for engaging with the engaging notches 56 of the casing 45 and for allowing the casing 45 and the engaging elements 48, 50 to be pivoted or rotated relative to the driving shank 30 with the actuating member 70, and thus for allowing the engaging elements 48, 50 to be selectively engaged with either side of the engaging surfaces 36 of the driving shank 30.

The actuating member 70 includes one or more (such as two) engaging depressions 74, 75 formed therein (FIG. 7) and communicating with the bore 71 of the actuating member 70, and the spring biased projection 38 of the driving shank 30 is extendible out of the driving shank 30 and engageable with either of the depressions 74, 75 of the actuating member 70 in order to anchor or retain or position the actuating member 70 and thus the casing 45 and the engaging elements 48, 50 to the driving shank 30 at the selected angular position, and thus to anchor or retain or position the engaging elements 48, 50 at the selected side of the engaging surfaces 36 of the driving shank 30, in order to determine and to adjust the rotating or driving direction of the driving shank 30 by the casing 45 and the bevel gears 51, 52.

A further tubular member or barrel or control ferrule or sleeve 77 is pivotally or rotatably engaged onto the driving shank 30, and includes a bore 78 formed therein for pivotally or rotatably receiving or engaging with the driving shank 30 and for allowing the sleeve 77 to be pivoted or rotated relative to the driving shank 30, and includes one or more engaging ears or flaps or keys or projections 79 extended axially therefrom for engaging with the engaging recesses 72 of the actuating member 70 and for allowing the actuating member 70 and thus the casing 45 and the engaging elements 48, 50 to be pivoted or rotated relative to the driving shank 30 by or with the sleeve 77 and thus for switching or changing the rotating or driving direction of the driving shank 30 by the bevel gears 51, 52.

An adapter or tool extension or socket or tool member 80 includes a cavity 81 formed in one end portion thereof for receiving or engaging with the other or outer or second end portion 33 of the driving shank 30 and solidly and stably attached or mounted or secured to the driving shank 30 with latches or fasteners or locks (not illustrated), force-fitted engagement, adhesives, welders or the like, and attached or mounted or secured to the driving shank 30 and the sleeve 77 for solidly and stably attaching or mounting or securing or coupling or anchoring or retaining the sleeve 77 to the tool member 80 and the driving shank 30, and includes an engaging hole 83 formed therein (FIGS. 1-2) for receiving or engaging with another tool member or fastener or tool bit or tool element (not illustrated), and the tool member 80 may further be solidly and stably secured to the driving shank 30 with a latch or lock or fastener 84.

In operation, as shown in FIGS. 3-6, when the tool member 80 is attached to or engaged with the other or outer or second end portion 33 of the driving shank 30 for engaging with the tool member or fastener (not illustrated) to be selectively rotated or driven by the ratchet driving tool in accordance with the present invention, the control ferrule 60 may be selectively rotated or driven by the user, relative to the housing 10, the driving or active bevel gear 52 may be selectively rotated or driven by the control ferrule 60, and thus the follower bevel gear 51 may be rotated or driven relative to the driving shank 30 with the bevel gears 44 of the gearing mechanism 4, and the driving shank 30 and the tool member 80 may thus be selectively and quickly rotated or driven by the bevel gears 51, 52 and the engaging elements 48, 50 in either direction.

The sleeve 77 may be selectively rotated or driven relative to the housing 10 and the driving shank 30 in order to rotate the actuating member 70 and the casing 45 relative to the driving shank 30 and to move or actuate the engaging elements 48, 50 to engage with either side of the engaging surfaces 36 of the driving shank 30 (FIG. 5) and to determine the rotating or driving direction of the driving shank 30 by the casing 45 and the bevel gears 51, 52. When the housing 10 is rotated or driven by the user, the barrel 40 and thus the bevel gears 44 of the gearing mechanism 4 and the bevel gears 51, 52 may also be rotated or driven by the housing 10, and the driving shank 30 may thus be selectively rotated or driven by the bevel gears 51, 52 with the engaging elements 48, 50 in a greater torque.

The ratchet driving tool may further include a hand grip or handle 20 for pivotally or rotatably receiving or engaging with or for supporting the housing 10, for example, the handle 20 includes two rings or flaps or ears 21, 22 formed or provided on top thereof for forming or defining a slot or groove or channel 23 between the ears 21, 22, and includes an aperture 24 laterally formed through the ears 21, 22 and intersected or communicating with the channel 23 that is formed between the ears 21, 22 for slidably receiving or engaging with a latch 90, and includes an insert or reinforcing member or block 25 received or engaged in the aperture 24 of one of the ears 21 and having a bore 26 formed in the block 25 for slidably and partially receiving or engaging with the latch 90, and having a slit 27 also formed in the block 25 and communicating with the bore 26 of the block 25.

The block 25 is preferably made of stronger materials, such as metal or plastic materials having a hardness and/or strength greater than that of the ear 21 of the handle 20 for reinforcing the ear 21 of the handle 20, and the block 25 includes a non-circular outer peripheral portion or outer contour or cross section, such as a hexagonal cross section for engaging with the ear 21 of the handle 20 and for preventing the block 25 from being pivoted or rotated relative to the ear 21 of the handle 20. The latch 90 includes a projection or key 91 extended outwardly therefrom and slidably engageable into the slit 27 of the block 25 for selectively attaching or anchoring or retaining the latch 90 to the ear 21 of the handle 20 and for preventing the latch 90 from being pivoted or rotated relative to the block 25 and the handle 20.

The holder body 1 includes an outer container or receptacle 95 having a compartment or chamber or space 96 formed therein for receiving or engaging with the housing 10, and the housing 10 includes one or more ribs or fins or protrusions 14 extended outwardly therefrom (FIG. 1) and force-fitted or engaged with or molded within the receptacle 95 for solidly and stably attaching or mounting or securing or coupling the housing 10 and the receptacle 95 together, and includes a through hole 16 laterally formed through the housing 10 (FIG. 1) and aligned with the aperture 24 of the ears 21 for slidably receiving or engaging with the latch 90 (FIGS. 8, 9) and for pivotally or rotatably attaching or mounting or securing or coupling the housing 10 and the receptacle 95 and the handle 20 together, and the housing 10 includes one or more engaging recesses or notches or depressions 17 formed therein and communicating with the through hole 16 of the housing 10 for slidably receiving or engaging with the key 91 of the latch 90.

Figure 9:
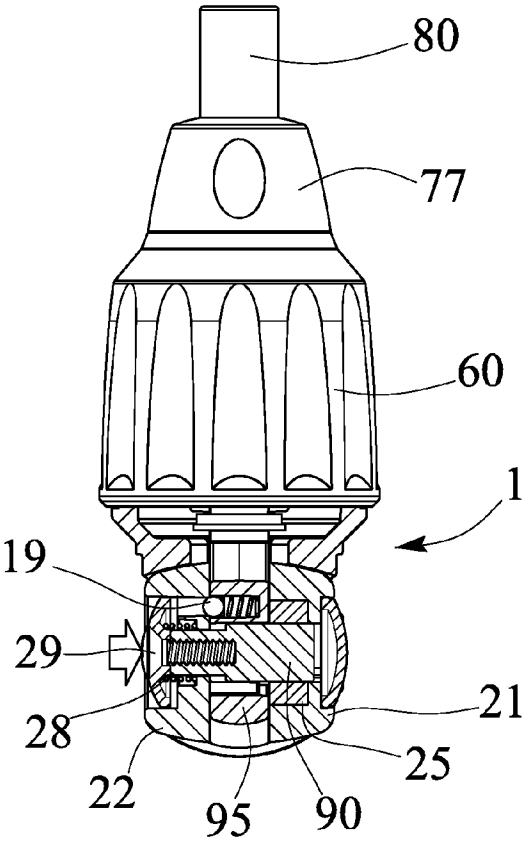
FIG. 9 is another top plan schematic view similar to FIG. 8, illustrating the operation of the ratchet driving tool.
Figure 8:
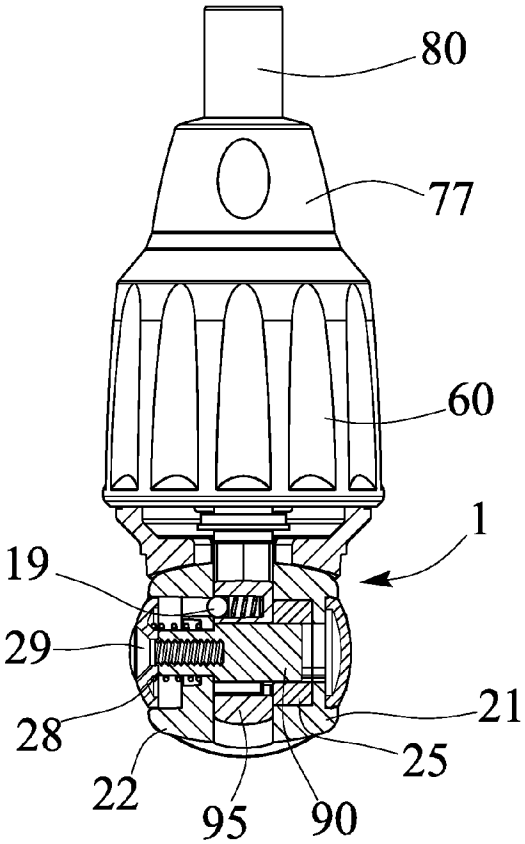
FIG. 8 is a top plan schematic view of the ratchet driving tool, in which a portion of the ratchet driving tool has been cut off for showing the inner structure of the ratchet driving tool.

As shown in FIGS. 1, 8 and 9, a spring biasing member 28 may be attached or mounted or secured to the latch 90 with a latch or lock or fastener 29 and may be engaged between the latch 90 and the handle 20 for biasing and forcing or moving the key 91 of the latch 90 to engage with either of the depressions 17 of the housing 10 and the slit 27 of the block 25 and to attach or anchor or retain the housing 10 to the handle 20 at the selected angular position. As shown in FIG. 9, when the fastener 29 and the latch 90 are moved or depressed into the ear 22 of the handle 20, the key 91 of the latch 90 may be disengaged or separated from the housing 10 for allowing the housing 10 and the receptacle 95 to be pivoted or rotated or adjusted relative to the handle 20 to the other selected or required angular position.

Figure 10:
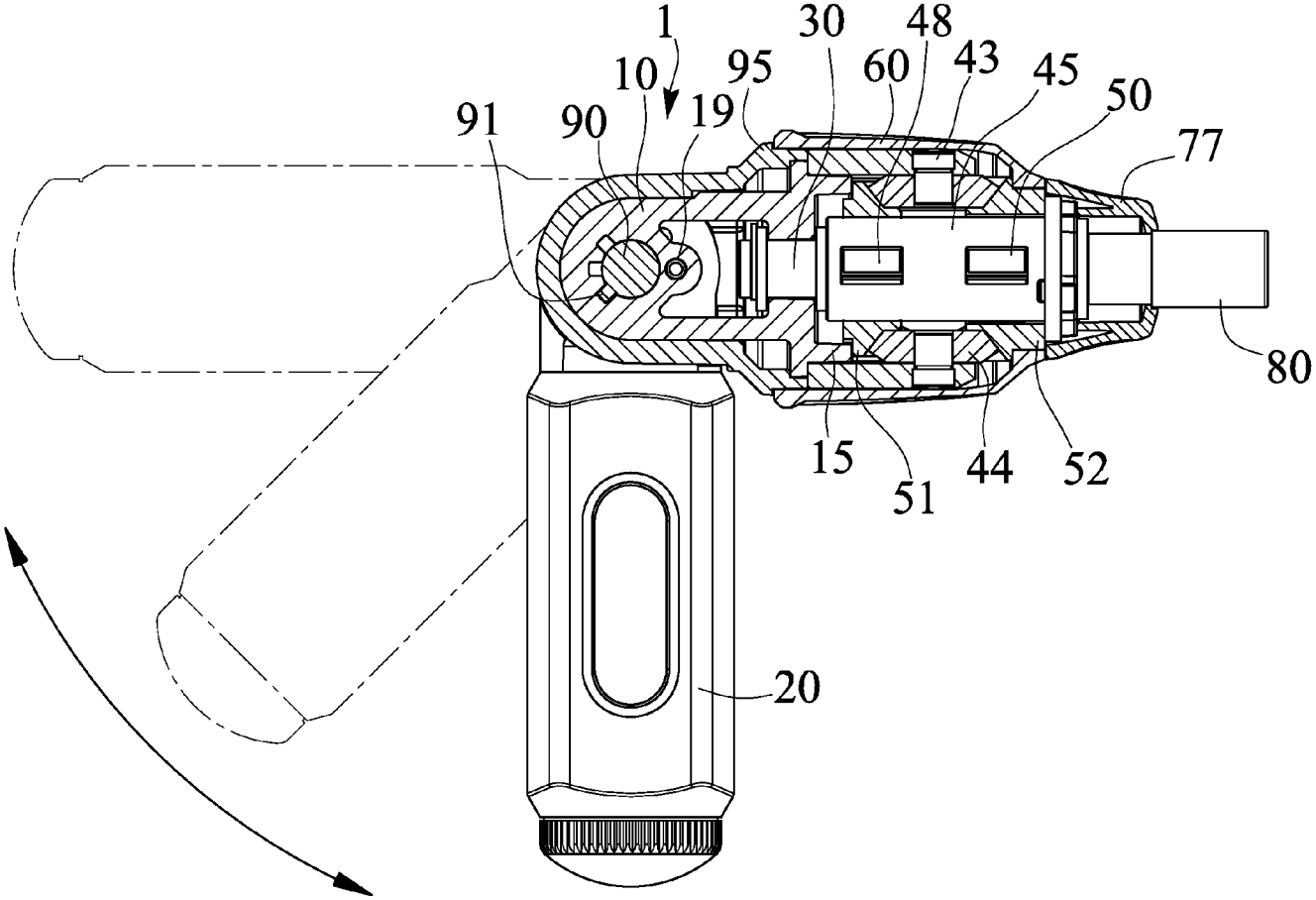
FIG. 10 is a cross sectional view similar to FIG. 4, illustrating the operation of the ratchet driving tool.

The key 91 of the latch 90 may be biased and forced and moved to engage with the other depression 17 of the housing 10 by the spring biasing member 28 again when the fastener 29 and the latch 90 are released, in order to attach or anchor or retain the housing 10 to the handle 20 at the other selected or required angular position (FIG. 10). The housing 10 may further include a cavity 18 formed therein for receiving or engaging with another spring biased projection 19 which is partially extendible out of housing 10 for selectively engaging with either of the ears 21, 22 of the handle 20 and for further attaching or securing or anchoring or retaining or positioning the housing 10 and the receptacle 95 to the handle 20 at the selected angular position, and thus for allowing the driving tool to be easily actuated or operated by the user. The housing 10 and the receptacle 95 of the holder body 1 may be formed or molded integral as a one-integral-piece or the like.

Accordingly, the ratchet driving tool includes an improved driving mechanism for selectively and quickly actuating or operating the ratchet driving tool to quickly engage with and to quickly rotate or drive the extension tools or fasteners or the like, and includes a handle adjustable and pivotal relative to the driving tool body for allowing the ratchet driving tool to be easily actuated or operated by the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet driving tool comprising:

a handle including an aperture laterally formed therein, a holder body including a housing pivotally attached to said handle and having a bore formed in said housing, said housing including a through hole laterally formed through said housing and aligned with said aperture of said handle, and including two depressions formed in said housing and communicating with said through hole of said housing, a ratchet driving mechanism attached to said housing, and a latch slidably received and engaged in said through hole of said housing and said aperture of said handle, said latch including a key slidably engageable with either of said depressions of said housing for anchoring said housing to said handle at a selected angular position.

2. The ratchet driving tool as claimed in claim 1, wherein said handle includes two ears provided thereon for forming a channel between said ears, and said aperture is laterally formed through said ears and communicating with said channel that is formed between said ears for slidably receiving and engaging with said latch.

3. The ratchet driving tool as claimed in claim 2, wherein said handle includes a block engaged in said aperture of one of said ears and having a bore formed in said block for slidably engaging with said latch, and having a slit formed in said block and communicating with said bore of said block for slidably engaging with said key of said latch.

4. The ratchet driving tool as claimed in claim 3, wherein said handle includes a spring biasing member engaged between said latch and said handle for biasing and forcing said key of said latch to engage with either of said depressions of said housing and said slit of said block.

5. The ratchet driving tool as claimed in claim 2, wherein said holder body includes a receptacle pivotally attached to said handle and engaged between said ears of said handle, and having a space formed in said receptacle for receiving and engaging with said housing.

6. The ratchet driving tool as claimed in claim 5, wherein said housing includes a protrusion extended outwardly therefrom and engaged with said receptacle for securing said housing and said receptacle together.

7. The ratchet driving tool as claimed in claim 5, wherein said housing includes a cavity formed therein, and a spring biased projection is engaged in said cavity of said housing for engaging with either of said ears of said handle and for anchoring said housing and said receptacle to said handle at the selected angular position.

8. The ratchet driving tool as claimed in claim 1, wherein said ratchet driving mechanism includes a driving shank having a first end portion engaged into said bore of said housing and rotatably secured to said housing for allowing said driving shank to be rotated relative to said housing, said driving shank includes a second end portion, and includes an intermediate portion having a non-circular cross section and having an engaging surface, a casing includes a compartment formed therein for rotatably receiving and engaging with said driving shank and for allowing said casing to be rotated relative to said driving shank, said casing is engaged onto and located around said intermediate portion of said driving shank, and said casing includes at least one groove formed in said casing and communicating with said compartment of said casing for receiving and engaging with a first engaging element which is engageable with said engaging surface of said driving shank, and includes at least one slot formed in said casing and communicating with said compartment of said casing for receiving and engaging with a second engaging element which is engageable with said engaging surface of said driving shank, a first gear and a second gear each include a bore formed therein for rotatably engaging onto said casing and for being engaged onto and located around said intermediate portion of said driving shank, for allowing said first and said second engaging elements to be selectively engaged between said first and said second gears and said engaging surface of said driving shank and for determining a driving direction of said driving shank by said casing and said first and said second gears, a barrel is attached to said housing and includes a chamber formed therein for receiving said first and said second gears and said casing and said driving shank, a gearing mechanism is engaged between said first and said second gears, and a control ferrule is rotatably engaged onto said barrel and engaged with said second gear for selectively rotating said first and said second gears and for selectively rotating said driving shank with said first and said second engaging elements, and said first and said second gears are drivable by said gearing mechanism and said barrel and said housing in order to drive said driving shank with said first and said second engaging elements.

9. The ratchet driving tool as claimed in claim 8, wherein said gearing mechanism includes at least two bevel gears engaged into said chamber of said barrel and rotatably attached to said barrel with shafts and engaged with said first and said second gears.

10. The ratchet driving tool as claimed in claim 9, wherein said at least two bevel gears and said shafts are equally spaced from each other.

11. The ratchet driving tool as claimed in claim 8, wherein said second gear includes a serrated portion provided thereon, and said control ferrule includes a serrated member formed thereon and engaged with said serrated portion of said second gear for allowing said second gear to be rotated by said control ferrule.

12. The ratchet driving tool as claimed in claim 8, wherein said housing includes a non-circular anchor provided thereon, and said chamber of said barrel includes a non-circular cross section for engaging with said non-circular anchor of said housing and for preventing said barrel from being rotated relative to said housing.

13. The ratchet driving tool as claimed in claim 8, wherein said casing includes at least one engaging notch formed therein, and an actuating member is rotatably engaged onto said driving shank and includes at least one engaging key for engaging with said at least one engaging notch of said casing and for allowing said casing and said first and said second engaging elements to be rotated relative to said driving shank with said actuating member.

14. The ratchet driving tool as claimed in claim 13, wherein said actuating member includes at least one engaging recess formed therein, and a sleeve is rotatably engaged onto said driving shank and includes at least one engaging projection extended therefrom for engaging with said at least one engaging recess of said actuating member and for allowing said actuating member and said casing and said first and said second engaging elements to be rotated relative to said driving shank by said sleeve.

15. The ratchet driving tool as claimed in claim 13, wherein said actuating member includes two engaging depressions formed therein, and said driving shank includes a spring biased projection extendible out of said driving shank and engageable with either of said depressions of said actuating member for positioning said actuating member and thus said casing and said first and said second engaging elements to said driving shank at selected positions.

* * * * *